US010710861B2

(12) United States Patent
Hancock

(10) Patent No.: US 10,710,861 B2
(45) Date of Patent: Jul. 14, 2020

(54) AUTOMATIC LID OPENER

(71) Applicant: Mary Hancock, Columbia, SC (US)

(72) Inventor: Mary Hancock, Columbia, SC (US)

( * ) Notice: Subject to any disclaimer, the term of this patent is extended or adjusted under 35 U.S.C. 154(b) by 121 days.

(21) Appl. No.: 15/830,709

(22) Filed: Dec. 4, 2017

(65) Prior Publication Data

US 2019/0169010 A1 Jun. 6, 2019

(51) Int. Cl.
*B67B 7/15* (2006.01)
*B67B 7/16* (2006.01)

(52) U.S. Cl.
CPC ..... *B67B 7/15* (2013.01); *B67B 7/164* (2013.01)

(58) Field of Classification Search
CPC ..... B67B 7/164; B67B 7/182; B67B 7/14; B67B 7/15
USPC ..... 81/3.2; 29/428
See application file for complete search history.

(56) References Cited

U.S. PATENT DOCUMENTS 3,686,824 A 8/1972 Rink et al.
4,265,071 A 5/1981 Smith et al.
5,301,433 A * 4/1994 Rogers ..... B67B 3/2006 30/401
5,647,251 A * 7/1997 Hardman ..... B67B 7/182 81/3.2
5,996,441 A 12/1999 Bateman
6,182,534 B1 2/2001 Hardman
6,862,954 B2 * 3/2005 Dubois ..... B67B 7/182 81/3.2
6,964,075 B1 * 11/2005 Iannacone, Jr. .... A47G 27/0487 30/294
7,146,878 B2 12/2006 Holland et al.
2003/0041560 A1 * 3/2003 Kemnitz ..... B65B 7/2828 53/331.5
2008/0229885 A1 * 9/2008 Mah ..... B67B 7/182 81/32

FOREIGN PATENT DOCUMENTS

DE 2726474 C2 4/1989

OTHER PUBLICATIONS

"Black & Decker JW200 Lids Off Jar Opener, White", Amazon.com, https://www.amazon.com/Black-Decker-JW200-Opener-White/dp/B00008GS9U/ref=pd_sbs_79_1?_encoding=UTF8&psc=1&refRID=0797GNJN3GESRTNN3824.

* cited by examiner

*Primary Examiner* — David B. Thomas
*Assistant Examiner* — Makena S Markman
(74) *Attorney, Agent, or Firm* — Insigne LLP

(57) ABSTRACT

Embodiments described herein provide an automatic lid opener comprising a base section, a top section, a middle section, at least one motor and a control panel. The base section comprises a base cavity capable of receiving a base portion of a jar, an inflatable grip within the base cavity, and a pump configured to inflate the inflatable grip, the inflatable grip configured to extend in a radially inward direction of the base cavity upon inflation and engage the base portion of the jar to form a grip, when the jar is positioned in the base cavity. The top section comprises a lid gripping mechanism and a lid rotation mechanism. The at least one motor is configured to operate at least one of the pump, the lid gripping mechanism, the rotation mechanism, or the height adjustment mechanism, and the control panel is configured to power the at least one motor.

20 Claims, 6 Drawing Sheets

AUTOMATIC LID OPENER

FIELD OF THE INVENTION

Embodiments of the present invention generally relate to the field of lid openers for jars, and more specifically to an automatic lid opener.

BACKGROUND

Jars find several commonplace applications, from storing food items and medicines, to doubling up as tool boxes, or storing other items. In several instances jar lids need to be tightened, and the lids tend to become so tightened that it is difficult to open the lids conveniently. The problem is particularly pronounced when opening a jar containing food items for the first time, because the lids is purposely tightened to preserve the food item.

Further, the problem is more severe for people who are physically unable to open a bottle/jar because of their medical disability for a short-term or long term, for example, joint immobility, lack of power due to old age, sickness or medical disability during a certain time, or other such reasons. While several mechanized electric jar openers exist, the design of such door openers is complex, they are difficult to operate, unsafe, expensive, or one or more of the above.

Therefore, it would be desirable to have an automatic lid opener that is convenient to operate and requires relatively less effort.

SUMMARY

Embodiments of the present invention provide an automatic lid opener for jars, substantially as shown in and/or described in connection with at least one of the figures, as set forth more completely in the claims.

These and other features and advantages of the present disclosure may be appreciated from a review of the following detailed description of the present disclosure, along with the accompanying figures in which like reference numerals refer to like parts throughout.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
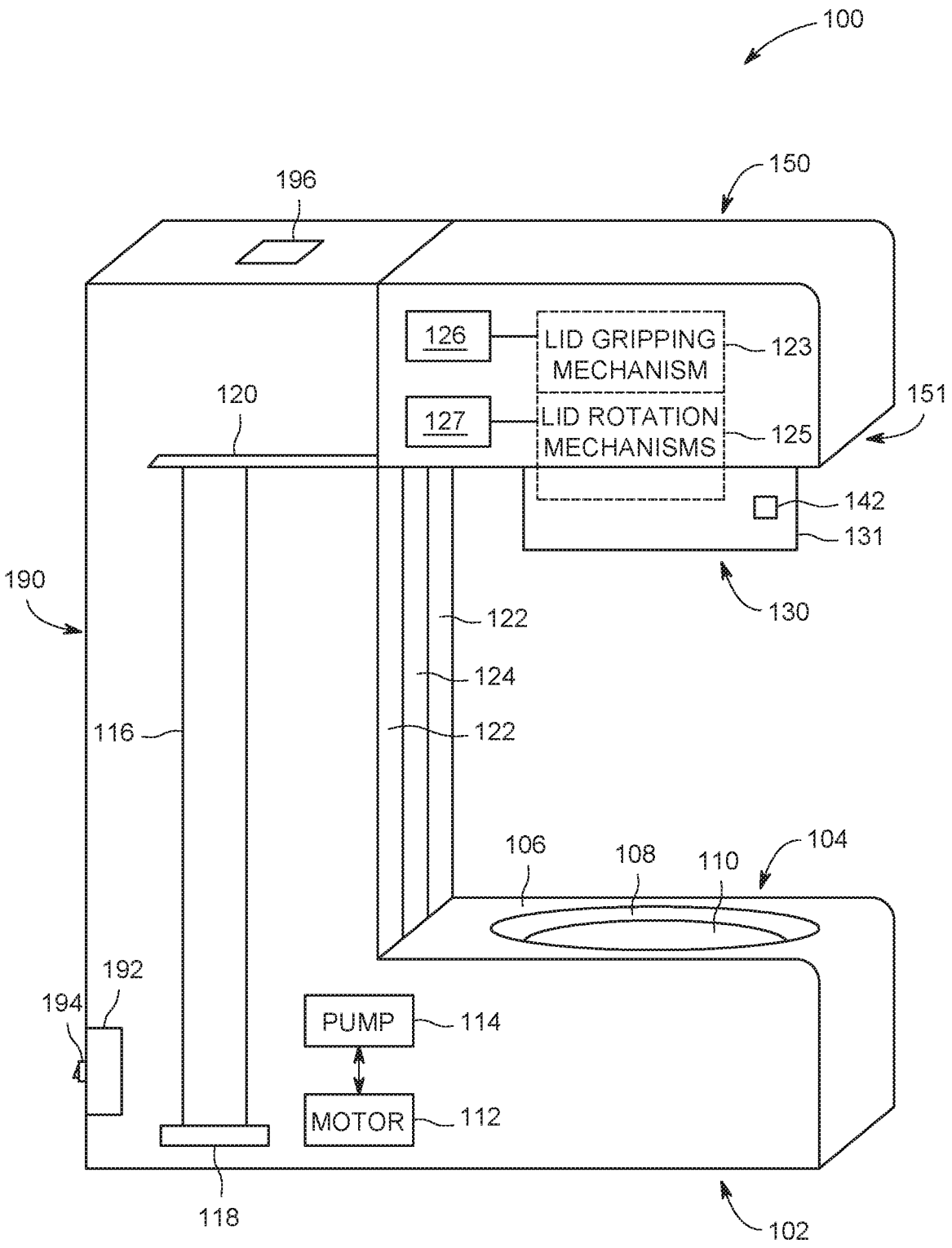
FIG. 1 depicts a schematic layout of components of an automatic lid opener, according to one or more embodiments.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DESCRIPTION

According to embodiments described herein, a lid opener comprises a base section comprising a base cavity for receiving a bottom portion of a jar therein, a top section comprising a lid cavity for receiving a lid of the jar therein, and a height-adjustable middle section for supporting the top section on the base. The height adjustable middle section employs known height adjustment mechanisms such as scissor lifts or screws to move the top section vertically with respect to the base section. The base section houses a bottom portion gripping mechanism comprising an inflatable material suitable for gripping jars, a pump to inflate the inflatable material, a pressure sensor to determine the pressure to which the inflation has taken place. The inflatable material extends from the base cavity, and when inflated using the pump, the inflatable material is configured to engage with and grip the base of the jar positioned in the base cavity. The lid cavity comprises a lid gripping mechanism comprising gripping racks having a gripping portion comprising rubber or other suitable gripping material, configured to tighten onto, and grip the lid, for example using a gear mechanism, such as a rack and pinion arrangement. The lid cavity also comprises a lid rotation mechanism comprising a jaw rack which houses gripping racks, and is coupled to a mechanism for rotating the jaw rack and the gripping racks therein. Rotation of the jaw rack rotates the gripping racks and the gripping portions, thereby rotating the lid gripped in the gripping portions, thereby opening the lid. One or more motors are mechanically coupled, using known techniques, to power the pump for inflating the inflatable material, the height-adjusting mechanism, the lid gripping mechanism and the lid rotation mechanism.

In operation, the inflatable material is inflated to grip the bottom portion of the jar, the height adjustment mechanism adjusts the height of the top section to position the lid cavity covering the lid and aligning the lid with the gripping portions of the gripping racks. The lid gripping mechanism is activated to grip the lid, and the lid rotation mechanism is activated to rotate the lid to loosen the tightened lid or to open the lid completely. Upon loosening or opening the lid, the lid gripping mechanism releases the grip on the lid, leaving the lid atop the jar. The height adjustment mechanism moves the top section upward to expose the loosened or opened lid, and the inflatable material is deflated to loosen the grip on the bottom portion of the jar. In this manner, the lid is loosened or opened conveniently, and the jar is ready for removal from the automatic lid opener. The automatic lid opener therefore assists those with physically disability, such as temporary disability brought on by illness or physical injury, or permanent disability brought on due to joint restraint, old age and the like. The automatic lid opener is also suitable for daily household use, to enhance convenience and avoid need to use excessive force to open tightened lids.

FIG. 1 is a schematic illustration of an automatic lid opener 100, according to various embodiments. The opener 100 comprises a base section 102, a top section 150, and a middle section 190. The base section 102 comprises a base cavity 110 designed for receiving and gripping a bottom portion of a jar. The top section 150 comprises a lid cavity 130 designed for receiving a top portion of the jar, the top portion of the jar comprising a lid. The top section 150 is further configured to grip and rotate the lid, in order to assist removing the lid and open the jar to access the contents therein. The middle section 190 comprises a height-adjustment mechanism 116 to move the top section 150 vertically with respect to the base section 102, in order to fit jars of different heights between the base cavity 104 and the lid cavity 130. The base cavity 104 and the lid cavity 130 are sized to be larger than most common sizes of jars and lids, respectively, to accommodate jars and lids of different diameters.

The base cavity 104 is located in and extends downward from a top faceplate 106 of the base section 102. The base cavity 104 is encircled by a wall 108, and an inflatable grip 110 extends from the wall 108. The inflatable grip 110 is pneumatically coupled to a pump 114 powered by a motor 112, using known techniques. In some embodiments, the motor 112 is a dual-shaft motor 112, and the motor 112 also powers the height-adjustment mechanism 116 using known techniques. In some embodiments (not shown) a separate motor is used to power the height-adjustment mechanism 116. The motor 112 receives electric power from a power module 192 controlled by a master switch 194.

The lid cavity 130 is located in the bottom faceplate 151 of the top section 150, and may comprise a lip 131 extending from and perpendicular to the bottom faceplate 151. The top section 150 houses a lid gripping mechanism 123 to grip the lid, and a lid rotation mechanism 125 to rotate the lid, in order to loosen or open the lid. The top section 150 further comprises a motor 126 to power the lid gripping mechanism 123 and a motor 127 to power the lid rotation mechanism 125. However, in some embodiments, one of the two motors 126, 127 is configured to power the lid gripping mechanism 123 and also the lid rotation mechanism 125, using known transmission and switching means. The motors 126 and 127 are powered by the power module 192. Portions of the lid gripping mechanism 123 and/or the lid rotation mechanism 125 may extend into the lid cavity 130. The lid cavity 130 provides a volume for housing the lid of the jar, temporarily, for the purpose of gripping and opening the lid. A contact or proximity sensor 142 is positioned in the lid cavity 130 to help position the lid in the lid cavity 130.

The middle section 190 comprises an inner faceplate 122 comprising a vertically extending slot 124 therethrough, to allow for vertical motion of the top section 150. The height-adjustment mechanism 116 comprises a base 118 anchored in the base section 102, and a top 120 configured to bear the load of the top section 150, using known techniques. The middle section 190 comprises a control panel 196 for controlling the power module 192, and thereby the operation of the motors 112, 126 and 127, and thereby the inflatable grip 110, the height-adjustment mechanism 116, the lid gripping mechanism 123 and the lid rotation mechanism 125. The control panel 196 further includes a user interface to enable a user of the opener 100 to control the inflatable grip 110, the height-adjustment mechanism 116, the lid gripping mechanism 123 and the rotation mechanism 125. In some embodiments, the user interface comprises one or more of a digital display, a touch screen digital display, buttons, knobs, and other well-known input and output mechanisms. In some embodiments, the control panel 196 is programmed to control the inflatable grip 110, the height-adjustment mechanism 116, the lid gripping mechanism 123 and the rotation mechanism 125 automatically, in order to open the lid of a jar positioned in the opener 100, for example using one or more sensors, as described further below. In some embodiments, the control panel 196 is programmed to increase or decrease, incrementally, the applied power in one or more of the inflatable grip 110, the lid gripping mechanism 123, or the lid rotation mechanism 125, to arrive at a suitable setting to loosen or open the lid.

Figure 2:
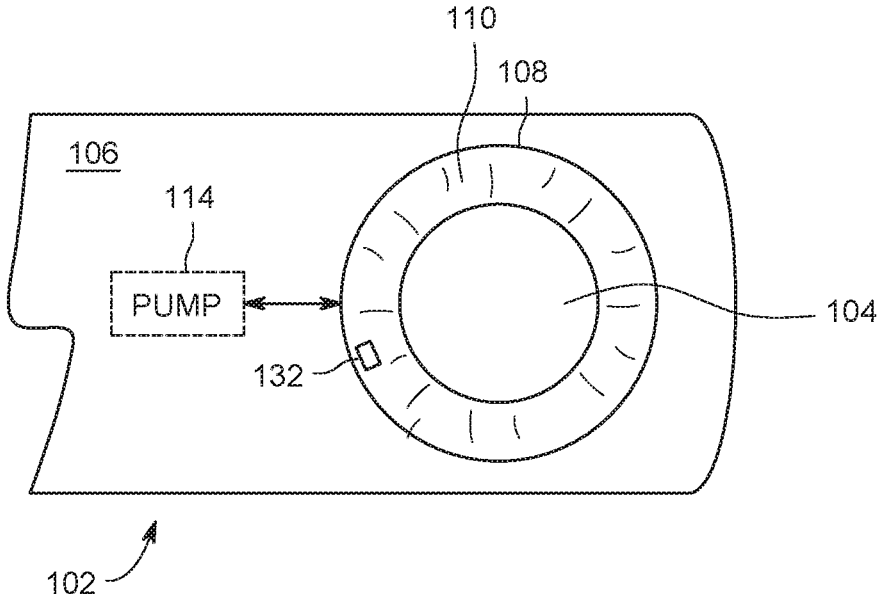
FIG. 2 depicts a top view of a portion of the base section of the automatic lid opener of FIG. 1, according to one or more embodiments.

FIG. 2 depicts a top view of a portion of the base section 102 of the automatic lid opener 100 of FIG. 1, according to one or more embodiments. The inflatable grip 110 comprises a pressure sensor 132 to measure the pressure inside the inflatable grip 110, which is used to infer the pressure exerted by the inflatable grip 110 on a bottom portion of a jar positioned in the cavity 104. According to some embodiments, the control panel 196 uses the pressure data from the sensor 132 to automatically control the inflation of the inflatable grip 110. According to some embodiments, the control panel pressurizes the inflatable grip 110 to a pressure between about 5 psi to about 15 psi, which has been found to be suitable to grip the jar immovably, in order to rotate the lid in a direction to open the lid. This pressure has been found suitable for bottles and jars made from plastic, glass, metal or a combination thereof. However, in some embodiments, pressure between about 2 psi to about 25 psi may be used. Further, a user may reprogram the pressure to which the control panel 196 pressurizes the inflatable grip 110 using the control panel 196, in case a higher pressure is needed or a lower pressure is sufficient to generate adequate grip on the bottom portion of the jar. In the embodiment depicted in FIG. 2, the inflatable grip 110 is shown in a continuous circular configuration alongside the wall 108, however, in some embodiments, the inflatable grip 110 comprises several disjoint inflatable grips. One or more sensors may be deployed to measure the pressure of one or more of the several disjoint inflatable grips, and the measured pressure is used by the control panel 196 to control the inflation of the several disjoint inflatable grips.

Figure 3A:
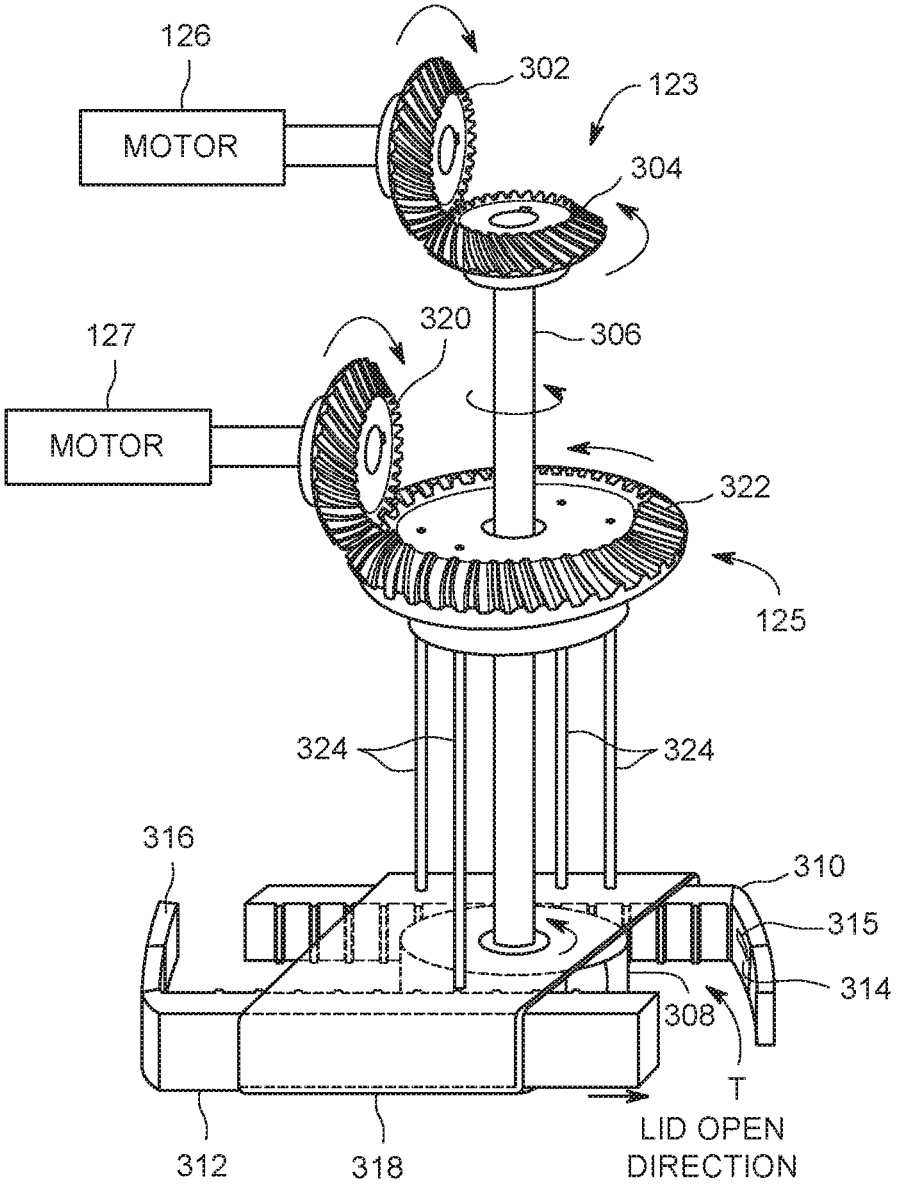
FIG. 3A depicts a schematic of a lid gripping mechanism and a lid rotation mechanism of the automatic lid opener of FIG. 1, according to one or more embodiments.

FIG. 3A depicts a schematic of the lid gripping mechanism 123 and the lid rotation mechanism 125 of the automatic lid opener of FIG. 1, according to one or more embodiments. The lid gripping mechanism 123 comprises a gear 302 coupled to the motor 126, and the gear 302 mates with a gear 304 coupled to a shaft 306. In some embodiments, the motor 126 is directly coupled to the shaft 306, and rotates the shaft 306 directly, without requiring the gears 302 or 304. The shaft 306 rotates another gear 308. The gear 308 is a circular gear, and mates with first and second gripping racks 310, 312 positioned on diametrically opposite sides, forming a rack (310, 312) and pinion (308) arrangement. The gear 308, and the gripping racks 310, 312 are borne by and held together by a jaw rack 318, which constrains the gear 308, and the gripping racks 310, 312 to stay in an engaged configuration. The shaft 306 passes through an opening in the jaw rack 318 and is coupled rigidly with the gear 308, such that the rotation of the shaft 306 rotates the gear 308 in a corresponding motion. Each of the gripping racks 310, 312 has a gripping portion 314, 316 extending perpendicular to the gripping racks 310, 312, on opposite sides of the gear 308, respectively. The gripping portions 314, 316 are shaped to not interfere with the gear 308, while still having a reach to grip the lid. For example, in the embodiment shown by FIG. 3A, the gripping portions 314, 316 extend vertically downward from the gripping racks 310, 312 to be able to grip a lid positioned underneath the gear 308. The diameter of the gear 308 is chosen to be smaller than most common lid sizes. In some embodiments (not shown), the gripping portions 314, 316 are indented toward each other in order to be able to grip a lid having a diameter smaller than that of the gear 308.

As shown in FIG. 3A, upon circular rotation of the gear 308 in an anticlockwise direction, the racks 310, 312 move linearly, in opposite directions, bringing the gripping portions 314, 316 close to each other. The gripping portions 314, 316 are brought close to a desired distance, thereby gripping a lid in between the gripping portions 314, 316. In some embodiments, one or more pressure sensor 315, such as a capacitive pressure sensor, is installed in the gripping portion 314 or 316 or both, to determine when pressure between the gripping portions 314, 316 and the lid is sufficient to grip the lid securely. In some embodiments, the control panel 196 controls the operation of the lid gripping mechanism 123 based on the readings of the sensor 315. For example, the control panel 196 is configured to power the motor 126 to tighten the grip of the gripping portions 314, 316 on the lid if the sensor 315 detects that the pressure is insufficient to grip the lid securely. On the other hand, if the control panel 196 detects that the pressure is higher than is needed, the control panel 196 powers the motor 126 (e.g. in an opposite direction) to loosen the grip on the lid. The gripping portions 314, 316 include gripping material, for example, natural rubber, latex, silicone, blends thereof, or several other materials known in the art having desired gripping properties.

The lid rotation mechanism 125 comprises a gear 320 coupled to the motor 127, and the gear 320 mates with the gear 322. The gear 322 is coupled to one or more gripping screws 324, which rigidly couple the gear 322 with the jaw rack 318. Rotation of the gear 322 causes rotation of the jaw rack 318, and the gripping racks 310, 312 borne therein. When a lid of a jar is securely gripped in between the griping portions 314, 316 of the gripping racks 310, 312, respectively, then, an anticlockwise rotation of the gear 322 will cause the lid to rotate in an anticlockwise direction, thereby loosening or opening the lid. The gear 322 is rotated in the anticlockwise direction, for example, by powering the motor 127 to rotate the gear 320 in a clockwise direction, as shown in FIG. 3A. The gear 322 includes an opening 323 for allowing the shaft 306 to pass through the opening 323 freely, in order to couple rigidly with the gear 308. In FIG. 3A, the arrows along the gears 302 and 320 depict clockwise motion when looking toward the visible face of the gears 302 and 320. Corresponding to the rotation of the gear 302, the gear 304, the shaft 306 and the gear 308 rotate in an anticlockwise direction when looking at the gears 304, 308 and the shaft 306 in a vertically downward direction. Corresponding to the rotation of the gear 320, the gear 322 rotates in an anticlockwise direction when looking at the gear 322 in a vertically downward direction. Those skilled in the art would readily ascertain the motions to be imparted to the gears 302 or 304, and to 320 in order to rotate the gears 308 and 322, respectively, as discussed above.

Figure 3B:
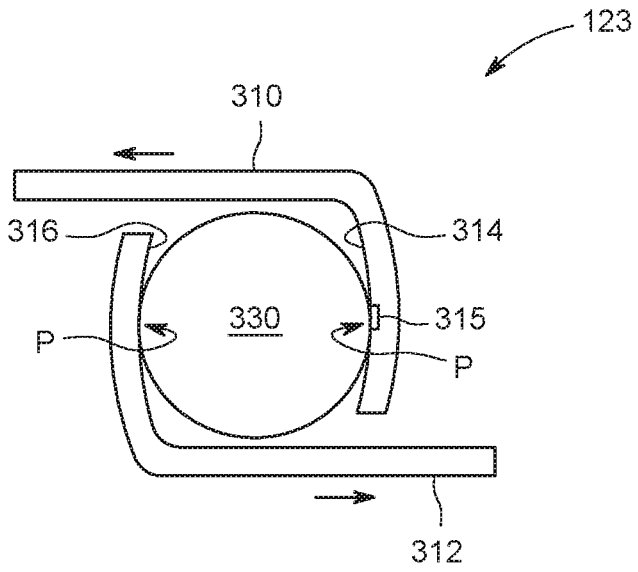
FIG. 3B depicts gripping of a lid using the lid griping mechanism, according to one or more embodiments.

FIG. 3B depicts gripping of a lid using the lid griping mechanism 123, according to one or more embodiments. The gear 308 rotates to move the racks 310 and 312 toward each other. Thereby, the gripping portions 314 and 316 grip a lid 330 from either side, forming a tight and immovable grip. In some embodiments, the control panel 196 controls the lid gripping mechanism 123 by controlling the motor 126 to drive the gear 308 suitably, in order to achieve a secure and immovable grip of the gripping portions 314, 316 on the lid.

Figure 3C:
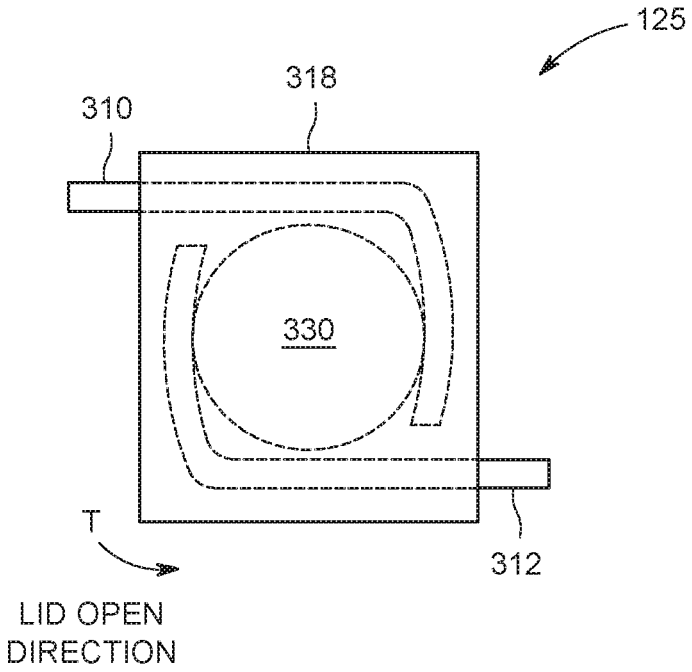
FIG. 3C depicts rotation of a lid using the lid rotation mechanism, according to one or more embodiments.

FIG. 3C depicts rotation of a lid using the lid rotation mechanism 125, according to one or more embodiments. Once the gripping portions 314, 316 have gripped the lid, the lid rotation mechanism 125 rotates the jaw rack 318 and the gripping racks 310, 312 therein. Due to the rotation of the racks 310, 312, the gripping portions 314, 316 and the lid 330 gripped immovably therein are also rotated. The lid rotation mechanism 125 is configured to rotate the jaw rack 318 in an anticlockwise direction, which causes an anticlockwise rotation of the gripping racks 310, 312, the gripping portions 314, 316, and the lid 330 gripped between the gripping portions 314, 316, thereby opening the lid 330. According to some embodiments, the lid rotation mechanism 125 rotates the lid to 1.5 rotations (that is, a rotation of 540 degrees), which is considered as sufficient amount of rotation to allow the lid of a jar to be loosened for being released from the jar. In some embodiments, the lid rotation mechanism 125 is configured for less or more rotation than 1.5 rotations. In some embodiments, the control panel 196 is configured to control the motor 127 powering the lid rotation mechanism 125 to drive the gear 320 to apply sufficient torque to loosen or open the lid. In some embodiments, the control panel 196 is configured to increase, automatically, the torque applied to the gear 320 and thereby to the gripping portions 314, 316, until such time the lid loosens. Once the lid is loosened or opened, the control panel 196 controls the motor 126 to rotate in an opposite direction in order to loosen the grip of the gripping portions 314, 316 on the lid, such that the loosened or opened lid rests atop the jar. Thereafter, the control panel 196 controls the motor 112 to release the grip of the inflatable grip 110 on the base portion, and to power the height adjustment mechanism to move the top portion 150 upward, thereby leaving the opened jar and lid in the automatic lid opener 100 for easy removal.

In some embodiments, the control panel 196 is configured to rotate the gear 322 in a clockwise direction in order to tighten the lid to a desired level of tightness. In some embodiments, the control panel 196 uses the torque or power required by the motor 127 to ascertain the level of tightness achieved.

Figure 3D:
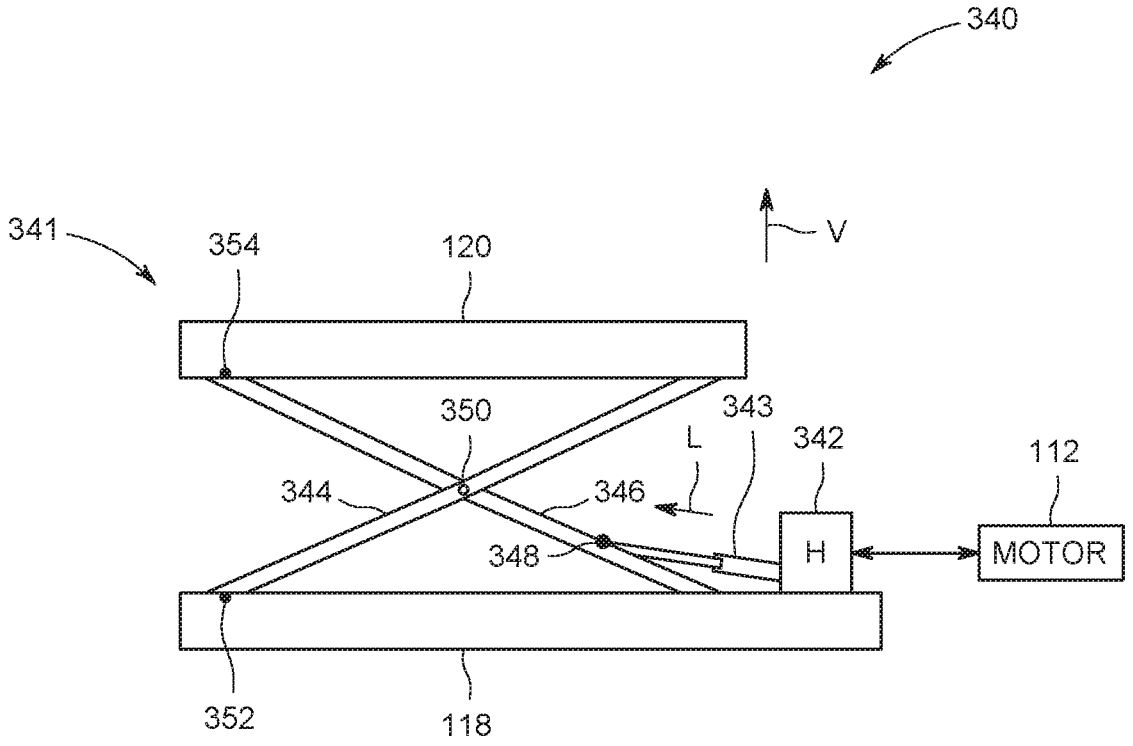
FIG. 3D depicts a height-adjustment mechanism used to vary the height of the top section of the automatic lid opener of FIG. 1, according to one or more embodiments.
Figure 4:
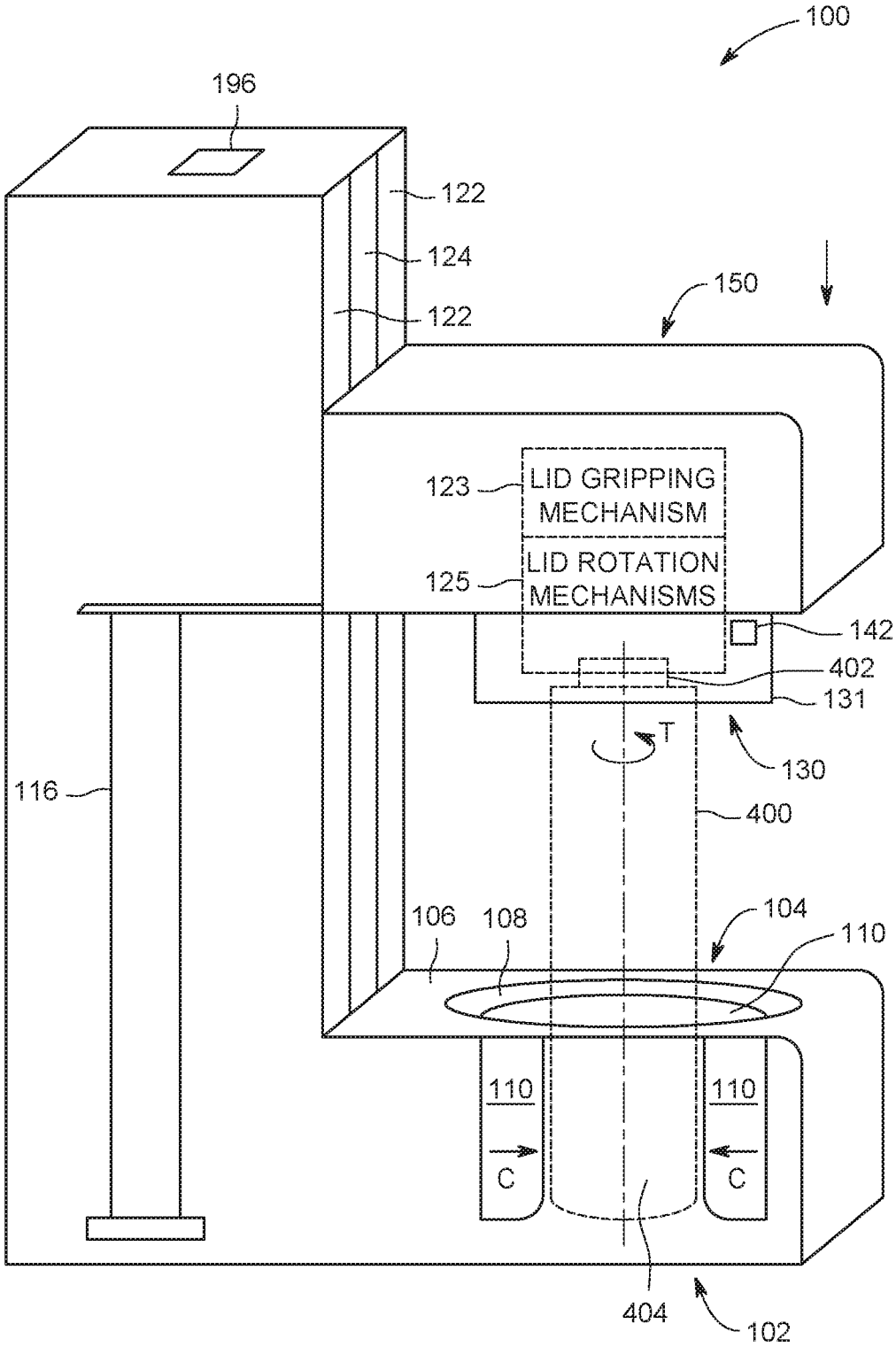
FIG. 4 depicts the automatic lid opener in an in-use configuration, according to one or more embodiments.

FIG. 3D depicts a height-adjustment mechanism 340 for varying the vertical separation between the top section 150 and the base section 102, for example as also shown in FIG. 4, according to one or more embodiments. The height adjustment mechanism 340 is a scissor lift 341 powered by a hydraulic lift 342, which are well known in the art. In some embodiments, the hydraulic lift 342 is powered by the motor 112. The scissor lift comprises of arm links 344 and 346, coupled at a point 350 which allows relative rotational motion between the arm links 344 and 346. The arm link 344 is also anchored to the base 118 at the point 352, which allows for relative rotational motion between the arm link 344 and the base 118. The opposite end of the arm link 344 is free to move with respect to the top 120. The arm link 346 is anchored to the base at point 354, which allows for relative rotational motion between the arm link 346 and the top 120. The opposite end of the arm link 346 is free to move with respect to the base 118. The arm link 346 is mechanically coupled with a power arm 343 of the hydraulic lift 342 at point 348, which allows for relative rotation between the arm link 346 and the power arm 343. The hydraulic lift 342 is configured to apply a linear force L (via the power arm 343) to the point 348. Application of a linear force L results vertical motion V of the scissor lift 341. If the power arm 343 exerts force at the point 348 to move the arm link 346 inward (in the direction of arrow of L), the vertical motion V in the upward direction is achieved, and conversely, if the power arm 343 exerts force at the point 348 in an opposite direction, the vertical motion in a downward direction will be achieved. The base 118 is anchored to a stable position, for example, in the base section 102 of the opener 100. The motor 112 is connected to the hydraulic lift 342 to power the hydraulic lift 342. The hydraulic lift 342 then applies force L to the scissor lift 341 as discussed above, to move the top 120 up or down. The top 120 forms a platform to support the top section 150, and the top 120 is structurally supported by the scissor lift 341 at all times. Those skilled in the art will appreciate that while a hydraulic scissor lift based height adjustment mechanism 116 is illustrated herein, the embodiments described herein may employ any of the well-known height adjustment mechanisms known in the art, including, but not limited to, a platform that is movable vertically using a pulley or a screw arrangement, for example, a dumbwaiter system.

FIG. 4 depicts the automatic lid opener 100 in an in-use configuration, according to one or more embodiments. A jar 400, shown using broken line, is positioned in the opener 100, and specifically in the base cavity 104 of the base section 102. The lid cavity 130 comprises a contact sensor 142 to sense contact with a lid positioned in the opener 100. The control panel 196 utilizes the contact sensor 142 data to manipulate the height-adjustment mechanism via the motor 112, in order to position the top section 150 according to the height of the jar. Specifically, the control panel 196 positions the top section 150 such that the gripping portions 314, 316 are aligned with the lid, and upon being brought close together (as explained above) grip the lid securely. Accordingly, the top section 150 has moved along the slot 124 vertically downward, using the height adjustment mechanism 116, to adjust according to the height of the jar 400, such that the cavity 130 encloses a lid 402 of the jar 400. The inflatable grip 110 is inflated to apply a compressive force C which results in a grip being formed between the bottom portion 404 of the jar 400 and the inflatable grip 110. The lid gripping mechanism 123 grips the lid, and the rotation mechanism 125 rotates the lid gripping mechanism with a torsional force T in order to loosen the lid 402 off the jar 400. The inflatable grip 110, the height-adjustment mechanism 116 are powered by the motor 112, the lid gripping mechanism 123 is powered by the motor 126, and the lid rotation mechanism 125 is powered by the motor 127.

In some embodiments, the control panel 196 controls the motors (112, 126, 127) as discussed with respect to FIG. 4 above automatically to loosen the lid 402 off the jar 400. According to some embodiments, the control panel 196 comprises a digital controller, a memory and support circuits. The digital controller may comprise one or more commercially available microprocessors or microcontrollers that facilitate data processing and storage. The various support circuits facilitate the operation of the digital controller and include one or more clock circuits, power supplies, cache, input/output device and circuits including touch screen or button based inputs and LCD/LED displays, and the like. The memory comprises at least one of Read Only Memory (ROM), Random Access Memory (RAM), disk drive storage, optical storage, removable storage and/or the like. The memory comprises processor executable instructions to control the power module and/or the motors 112, 126, 127 to control the inflatable grip 110, the height-adjustment mechanism 116, the lid gripping mechanism 123 and the lid rotation mechanism 125, for example, as described with respect to FIG. 4.

According to some embodiments, the control panel 196 begins automatic operation of the jar opener, for example, to open the jar 400 positioned in the opener 100 as shown in FIG. 4, upon receiving a command to do so via a user interface of the control panel 196 (not shown separately in the drawings). Upon receiving the command to begin automatic operation, the control panel 196 proceeds to operate the motor 112, via the power module 192, to manipulate the height adjustment mechanism 116 to move the top section 150 in a vertically downward motion till the sensor 142 indicates a contact with the lid 402, to the control panel 196. Upon detecting contact with the lid 402, the control panel 196 controls the motor 112 to control the height adjustment mechanism 116, in order to align the lid opening mechanism 123, and specifically the gripping portions 314, 316 with the lid 402. Next, the control panel 196 instructs the motor 112 to power the pump 114, which in turn inflates the inflatable grip 110. The inflated inflatable grip 110 contacts the jar 400 around the bottom portion 404 of the jar 400. The control panel 196 inflates the grip 110 till a predetermined pressure "C" is achieved in the grip 110, for example as measured by the sensor 132 positioned in the inflatable grip 110. The predetermined pressure C is sufficient to grip the jar 400 safely, without breaking the jar 400, and allowing application of torsional force to unscrew the lid 402, while the bottom portion 404 of the jar 400 is held securely by the inflatable grip 110. In some embodiments, the pressure C is set to a value in a range between about 5 psi to about 15 psi, however, the value of C can be reprogrammed by the user using the control panel 196, or the control panel 196 may automatically select a value of C outside this range. Next, the control panel 196 powers the motor 126 to operate the lid gripping mechanism 123, which tightens the gripping portions 314, 316 onto the lid 402. The control panel 196 tightens the gripping portions 314, 316 to achieve a pressure P between a range of about 5 psi to about 15 psi, for example, as measured by the pressure sensor 315. In some embodiments, the control panel 196 is configured to tighten the gripping portions 314, 316 to achieve a pressure P outside this range. In some embodiments, a user can configure a different pressure P for the gripping portions 314, 316 using the control panel 196. Next, the control panel 196 powers the motor 127 to operate the lid rotation mechanism 125, which then rotates the band 134 with torsional force T, in order to unscrew the lid 402 off the jar 400. According to some embodiments, the torsional force T between the range of about 5 Nm to about 22 Nm, has been found to be suitable for loosening or opening the lid 402 having sizes between 22 mm to 86 mm. In some embodiments the control panel 196 controls the motor 127 to apply a torque T outside this range, or a user may reprogram the value of T to be outside this range, using the control panel 196. A different value of torque T may be needed depending on the size of the lid 402 and/or the tightness with which the lid 402 is closed. In some embodiments, the control panel 196 instructs the motor 127 to apply the torque T till the lid 402 is completely unscrewed and removed off the jar 400. In some embodiments, the control panel 196 instructs the motor 127 to apply the torque to loosen the lid 402, but not completely open or unscrew the lid 402 off the jar 400, so that the lid 402 may be manually unscrewed off (for example, by a user) completely to be removed off the jar 400. Such and other preferences may be configured into the control panel 196 by a user, for example via a user interface of the control panel 196. Next, the control panel 196 controls the motor 126 to loosen the grip of the gripping portions 314, 316 on the lid 402 to release the lid 402 from the grip of the gripping portions 314, 316, and deflates the inflatable grip 110 (for example, via a release valve) to release the bottom portion 404 from the inflatable grip 110. Next, the control panel 196 controls the motor 112 to power the height adjustment mechanism 116 to restore the top section 150 to its original position, for example, as illustrated in FIG. 1, ending the automatic operation of the opener 100. In this manner, the lid 402 of the jar 400 is loosened or opened automatically, and the jar 400 is ready for removal and use.

In some embodiments, the control panel 196 is programmed to adjust, automatically, the gripping pressure C on the bottom portion 404, the gripping pressure P on the lid 402, and the applied torque T on the lid 402. For example, if the lid 402 has a large diameter, additional torque T may be needed. Additional pressure C to the bottom portion 404 and/or to the lid 402 (P) may be needed if the jar 400 is large, or if the lid 402 is screwed on too tightly, or if the applied pressures C to the bottom portion 404 and/or P to the lid 402 are insufficient in gripping the bottom portion 404 and/or the lid 402 securely. The adjustments to the pressures C and P, and the torque T may be made incrementally, or according a predefined scheme, several of which will readily occur to those of ordinary skill. In some embodiments, the control panel 196 is configured with predefined threshold values for one or more of the pressure C, pressure P, or torque T. The threshold values may be a safety limit so as to not damage either the jar or the equipment. Several such programming configurations for the control panel 196 will occur to those of ordinary skill and are contemplated within the scope and spirit of the present invention as defined by the claims. In some embodiments, the control panel is configured to automatically operate the opener 100 upon being powered up, for example using the switch 194.

As discussed earlier, the control panel 196 is programmable by a user, who may program the values of pressures C, P and the torque T. The user may also program the control panel 196 to define the sequence in which the pressures C, P or the torque T is applied and/or released, thereby offering control of the operation of the automatic lid opener 100 to the user. In some embodiments, the control panel 196 warns the user if the user attempts to program a value of pressures C, P or torque T that exceed the predefined threshold values. In some embodiments, the control panel 196 is configured to disallow the user to configure a value of pressures C, P or torque T that exceed the predefined threshold values.

While specific examples of the lid gripping mechanism 123, the lid rotation mechanism 125, and the height adjustment mechanism 116 are shown in FIGS. 3A-D, such examples are not meant to limit the embodiments described herein. Other height adjustment mechanisms, for example, a screw based lift, a conveyer belt lift system, a pulley based mechanism, stretchable ribs, slot-based mechanism, or a telescoping channel may be used instead of the scissor lift of FIG. 3D. Similarly, other lid gripping mechanisms, such as tightening arms may be used instead of the gripping racks 310, 312 of FIGS. 3A-3C. Further, while three motors 112, 126 and 127 have been described, the configuration is not limited so three motors. In some embodiments, an individual motor is used to power each of the pump 114 for inflating the inflatable grip 110, the hydraulic lift 342 for the height adjustment mechanism 116, the lid gripping mechanism 123, and the lid rotation mechanism 125. In some embodiments, one motor is used to power each of the pump 114 for inflating the inflatable grip 110, the hydraulic lift 342 for the height adjustment mechanism 116, the lid gripping mechanism 123, and the lid rotation mechanism 125, and in such embodiments, well known transmission mechanisms and switching mechanisms are used to transmit and switch power from the one motor to each of the pump 114 for inflating the inflatable grip 110, the hydraulic lift 342 for the height adjustment mechanism 116, the lid gripping mechanism 123, and the lid rotation mechanism 125. The above and various other such alternatives would occur readily to those skilled in the art without departing from the scope and spirit of the embodiments described herein.

Further, the positions of the various components illustrated in the drawings with respect to the opener 100 are only for the purposes of explanation, and those skilled in the art would readily ascertain alternate configurations for placing such components, and deriving transmission from such positions, without departing from the scope and spirit of the embodiments described herein.

It is also noted that methods, apparatuses or systems that would be known by one of ordinary skill have not been described in detail so as not to obscure inventive subject matter. While the embodiments described herein recite specific examples, other configurations with different permutations and combinations of features described herein would occur readily to those skilled in the art, and included within the scope and the spirit of the invention as embodied by the claims.

The invention claimed is:

1. An automatic lid opener, comprising:

a base section comprising a base cavity surrounding a perimeter of a container, an inflatable grip within the base cavity for applying a predetermined pressure to the perimeter of the container, a pump configured to inflate the inflatable grip, the inflatable grip configured to extend in a radially inward direction of the base cavity upon inflation;

a top section comprising a lid cavity, a lid gripping mechanism comprising a first gripping rack comprising a first gripping portion at an end of the first gripping rack, a second gripping rack comprising a second gripping portion at an end of the second gripping rack, the second gripping portion at an end opposite to the first gripping portion, and a first gear mating with the first and the second gripping racks, the first gear positioned between the first and the second gripping racks, and configured to move the first gripping rack in a direction opposite to the movement of the second gripping rack, thereby capable of increasing or decreasing the distance between the first gripping portion and the second gripping portion, and a lid rotation mechanism disposed within the lid cavity and comprising a jaw rack for bearing and rotating the two gripping racks and the first gear;

a middle section comprising a height adjustment mechanism bearing the top section, the height adjustable mechanism operable to move the top section to adjust the vertical separation between the top section and the base section;

at least one motor configured to operate at least one of the pump, the lid gripping mechanism, the rotation mechanism, or the height adjustment mechanism; and a control panel operably coupled with and configured to control the at least one motor to power at least one of the pump to inflate the inflatable grip, the lid gripping mechanism to adjust the distance between the gripping portions, the lid rotation mechanism to rotate the jaw rack and the gripping portions borne in the jaw rack, or the height adjustment mechanism to move the top section;

wherein the middle section and the inflatable grip are stationary relative to the base section.

2. The opener of claim 1, further comprising a first pressure sensor located in the base section to measure pressure in the inflatable grip.

3. The opener of claim 2, wherein the first pressure sensor is located inside the inflatable grip.

4. The opener of claim 1, wherein the inflatable grip comprises at least one of a flexible or an inflatable material.

5. The opener of claim 2 further comprising a pressure sensor located in the first or the second gripping portions to measure the pressure exerted on the lid.

6. The opener of claim 1, wherein the lid gripping mechanism further comprises a first shaft rigidly coupled to the first gear, and a second gear rigidly coupled to the first shaft, the rotation of the second gear configured to rotate the first gear correspondingly, wherein the second gear is rotated by the at least one motor, or a third gear coupled to the at least one motor.

7. The opener of claim 6, wherein the lid rotation mechanism further comprises a fourth gear, at least one screw rigidly coupling the fourth gear to the jaw rack, the fourth gear rotatable to rotate the jaw rack in a corresponding direction, and a fifth gear mating with the fourth gear, and configured to rotate the fourth gear thereby rotate the jaw rack, and the two gripping racks and the first gear borne therein, wherein the fifth gear is rotated by the at least one motor.

8. The opener of claim 7, wherein the at least one motor comprises a first motor for powering the pump for the inflatable grip and a hydraulic lift for the height adjustment mechanism, a second motor for powering the second gear of the lid gripping mechanism, and a third motor for powering the fifth gear of the lid rotation mechanism.

9. The opener of claim 8, wherein the control panel controls the first motor, the second motor and the third motor based on programmed instructions, or based on inputs received via a user interface.

10. The opener of claim 1, wherein the height adjustment mechanism comprises a scissor lift having a fixed base in the base section, and bearing the top section, and a hydraulic lift to power the scissor lift, wherein the scissor operable to move the top section in a vertical direction.

11. The opener of claim 1, further comprising a proximity sensor located in the lid cavity to sense the position of a lid of ajar, when the jar is positioned in the opener.

12. The opener of claim 11, wherein the control panel controls the height adjustment mechanism based on the input from the proximity sensor.

13. The opener of claim 11, wherein the height adjustment mechanism comprises at least one of a pulley based mechanism, stretchable ribs, a slot based mechanism, or a telescopic channel.

14. An automatic lid opener, comprising:

a base section comprising a base cavity capable of receiving a base portion of a jar, an inflatable grip within the base cavity, and a pump configured to inflate the inflatable grip, the inflatable grip configured to extend in a radially inward direction of the base cavity upon inflation and engage the base portion of the jar to form a grip, when the jar is positioned in the base cavity;

a top section operable to gripping and rotating a lid of the jar; and a middle section operable to move the top section to adjust the vertical separation between the top section and the base section, wherein the middle section remains stationary relative to the base section.

15. The opener of claim 14, further comprising a first pressure sensor located inside the inflatable grip.

16. The opener of claim 15, further comprising:

at least one motor configured to operate at least one of the pump, the lid gripping mechanism, the rotation mechanism, or the height adjustment mechanism; and a control panel operably coupled with and configured to control the at least one motor to power at least one of the pump to inflate the inflatable grip, the lid gripping mechanism, the lid rotation mechanism, or the height adjustment mechanism.

17. The opener of claim 16, wherein the top section comprises a lid gripping mechanism for gripping a lid of the jar, and a lid rotation mechanism for rotating the lid of the jar, and wherein the middle section comprises a height adjustment mechanism operable to move the top section to adjust the vertical separation between the top section and the base section.

18. The opener of claim 17, wherein the at least one motor comprises a first motor for powering the pump for the inflatable grip and the height adjustment mechanism, a second motor for powering the lid gripping mechanism, and a third motor for powering the lid rotation mechanism.

19. The opener of claim 18, wherein the control panel controls the first motor, the second motor and the third motor based on programmed instructions, or based on inputs received via a user interface.

20. A method for removing a lid from a container comprising the steps of:

inflating, to a predetermined pressure, an inflatable grip surrounding a perimeter of the container, the inflatable grip disposed within a base cavity;

gripping the lid using a lid gripping mechanism disposed within a top section; and rotating the lid using a rotation mechanism disposed within the top section;

wherein the lid gripping mechanism comprises a first gripping rack comprising a first gripping portion at an end of the first gripping rack;

a second gripping rack comprising a second gripping portion at an end of the second gripping rack, the second gripping portion at an end opposite to the first gripping portion; and a first gear mating with the first gripping rack and the second gripping rack, the first gear positioned between the first gripping rack and the second gripping rack, and configured to move the first gripping rack in a direction opposite to the movement of the second gripping rack, thereby configured to increase or decrease the distance between the first gripping portion and the second gripping portion; and wherein the base cavity is disposed within a base section.

* * * * *